United States Patent [19]

Shaffer

[11] Patent Number: 4,590,105

[45] Date of Patent: May 20, 1986

[54] ARTIFICIAL TREE AND METHOD OF MAKING THE SAME

[75] Inventor: Earl R. Shaffer, Muncy, Pa.

[73] Assignee: Herman Rynveld's Son Corporation, Muncy, Pa.

[21] Appl. No.: 667,585

[22] Filed: Nov. 2, 1984

[51] Int. Cl.[4] ..... A47G 33/06

[52] U.S. Cl. ..... 428/8; 156/61; 428/20

[58] Field of Search ..... 428/105, 107, 110, 113, 428/8, 18, 19, 20; 211/196, 205; 156/61

[56] References Cited

U.S. PATENT DOCUMENTS

| | | | |
|---|---|---|---|
| 1,689,530 | 10/1928 | Landers | 428/18 X |
| 2,125,907 | 8/1938 | Frei, Jr. | 428/18 X |
| 2,149,968 | 3/1939 | Kranz et al. | 428/18 X |
| 2,749,639 | 6/1956 | D'Agnillo | 428/8 |
| 3,064,379 | 11/1962 | Hertzberg | 428/18 X |
| 3,223,454 | 12/1965 | Dieffenbach | 428/20 X |
| 3,278,364 | 10/1966 | Dieffenbach | 428/18 X |
| 3,478,652 | 11/1969 | Goodridge | 428/18 X |
| 3,489,462 | 1/1970 | Oakey | 428/18 X |
| 3,548,694 | 12/1970 | Gelardi | 428/18 X |
| 3,551,268 | 12/1970 | Casadevall | 428/110 X |
| 3,594,260 | 7/1971 | Dieffenbach | 428/20 |
| 3,606,472 | 9/1971 | Rutkowski et al. | 428/18 X |
| 3,607,586 | 9/1971 | Hankus | 428/18 |
| 3,665,577 | 5/1972 | Dieffenbach | 428/18 X |
| 3,834,976 | 9/1974 | Mottel | 428/18 |
| 3,959,536 | 5/1976 | Chase | 428/20 X |
| 4,305,980 | 12/1981 | Spiegel | 428/20 X |
| 4,490,427 | 12/1984 | Grant et al. | 428/110 X |

*Primary Examiner*—Henry F. Epstein

*Attorney, Agent, or Firm*—Robbins & Laramie

[57] ABSTRACT

An artificial tree, simulating a Christmas tree, includes a vertical trunk and a plurality of limbs made of twisted wire extending from the trunk. A plurality of "wire brush" type filaments are arranged in parallel on a tape carrier. The tape carrier, with the filaments, is interleaved in the twisted wire of the limbs to provide the appearance of needles extending from the limb. This provides an inexpensive way of making a realistic looking artificial tree.

3 Claims, 13 Drawing Figures

ARTIFICIAL TREE AND METHOD OF MAKING THE SAME

SUMMARY OF THE INVENTION

In the manufacture of artificial Christmas trees, it is desirable to produce a tree having a pleasing appearance. It is particularly desirable to mask the wires which form the limb members, so that a natural appearing tree is produced. In order to reduce the cost of manufacture, the tree should be capable of mass production by machine assembly.

One attempt to solve this problem is disclosed in U.S. Pat. No. 4,305,980, entitled "Artificial Tree," hereby incorporated by reference. This patent discloses in FIG. 4, a plastic web 114, which is slitted to form frills 116. When the web is twisted into the wires forming the limbs 110, the frills are intended to give the appearance of pine needles, thereby hiding the wires forming the limbs (Col. 7, Lines 1–7).

The deficiency in this structure is that the needles on the branches of the tree are made of thin filament, wire stock, referred to as "brush stock" which closely simulates the appearance of pine needles. The plastic slit web does not simulate pine needles, especially when contrasted with the thin filament "brush stock" of the material simulating the needles of the limb.

Applicant has improved the appearance of artificial trees by devising a method wherein the same material used in making the needles for the branches is also used to fill in the limbs and disguise the presence of the wires which form the limb members.

Applicant has provided a method whereby filament needles are inserted into the limbs economically, on a continuous assembly basis, during the formation of limbs.

The method involves automatically arranging strands of filament material on adhesive material. The strands are positioned parallel to each other and the material, with the strands, is spirally wound into the wires of the limbs as they are twisted to form the limbs.

An alternative embodiment is to use a branch made of filament, and spirally wind it into the limbs as they are formed.

The resultant provides an economical way of producing a more naturally appearing tree.

DESCRIPTION OF THE INVENTION

Figure 1:
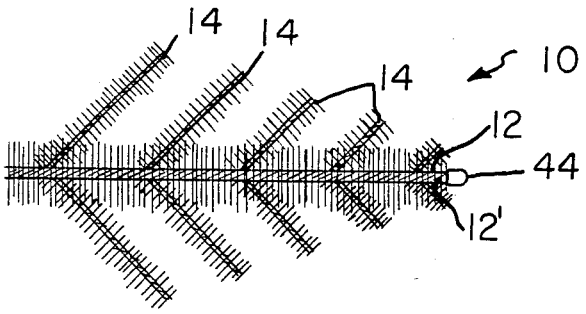
FIG. 1 illustrates a finished limb of an artificial tree, using a filament filler, according to the principles of the invention.

Referring to FIG. 1, a limb of an artificial tree, constructed according to this invention, is identified generally by the numeral 10. The limb is formed of a pair of heavy gauge wires 12, 12' which are twisted together to form a spiral member of sturdy construction. The limb has a plurality of branches 14 emanating therefrom to simulate the branches on a Christmas tree.

Figure 12:
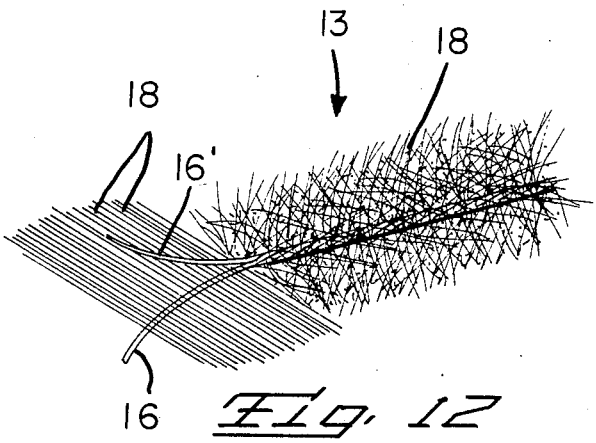
FIG. 12 illustrates a branch being assembled by twisting a pair of light gauge wires to capture filaments therebetween.
Figure 13:
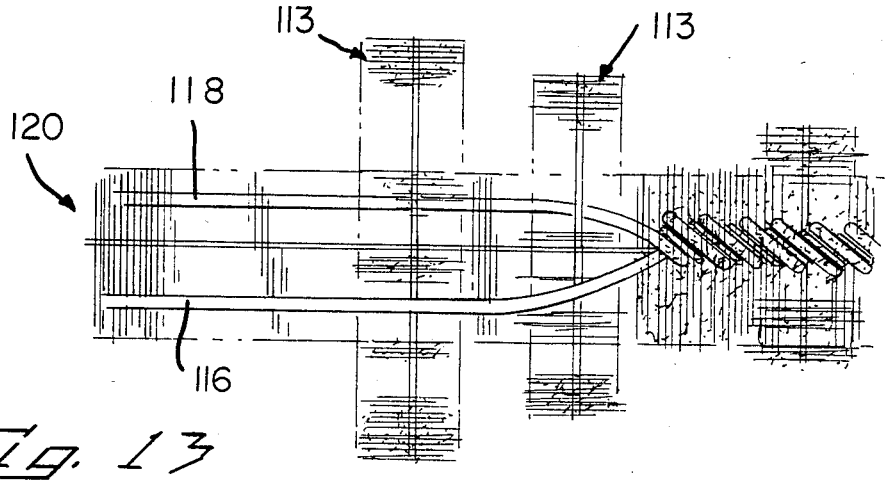
FIG. 13 illustrates an alternative embodiment wherein the assembly of a limb is accomplished by using a filler strip of light gauge wires with filaments captured therein.

The branches are held in the limb by twisting a spiral of the heavy gauge wires 12, 12' around each branch (FIG. 13). Each branch 13 is constructed by twisting a pair of light gauge wires 16, 16' (FIG. 12) with a plurality of thin filaments 18, (known as "brush stock") inserted therein, to capture the filaments in the wires. A filler strip 20, comprised of a carrier 22 and a plurality of filaments 24 (similar to filaments 18) is intertwined into the twisted heavy gauge wires 12, 12' to provide a Christmas tree limb simulating the appearance of pine needles and concealing the appearance of the heavy gauge wires.

Figure 2:
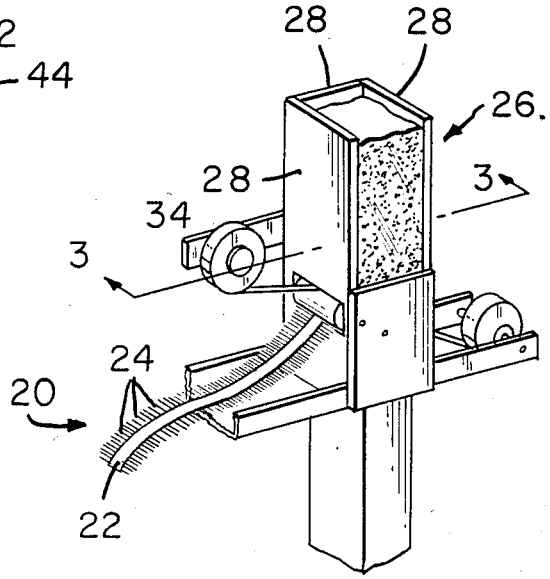
FIG. 2 is a perspective view of an applicator for applying filament to tape.
Figure 3:
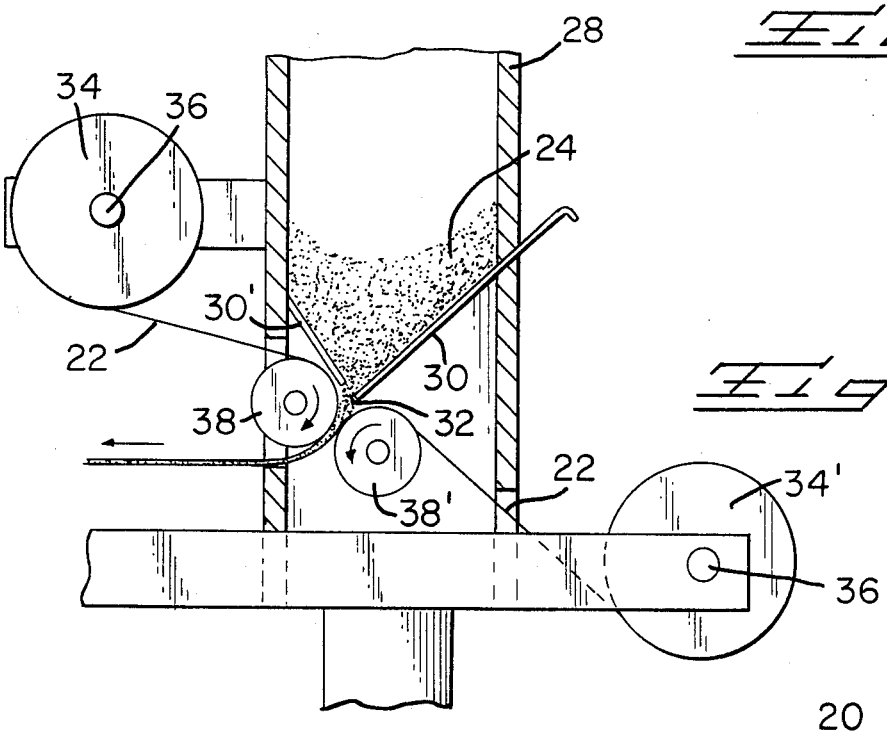
FIG. 3 is a cross section of the applicator taken along lines 3—3 of FIG. 2.
Figure 4:
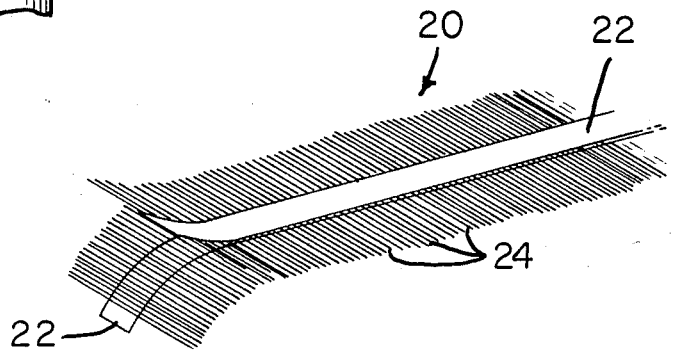
FIG. 4 is a perspective view of tape with filament needles applied thereto.

The assembly of the filler strip 20 (FIGS. 2 and 3) includes a box member 26, having sides 28 to contain a bulk supply of filaments 24. The bottom of the box member 26, has a pair of downwardly inclined planes 30, 30' with an opening 32, to permit the filaments to flow downwardly (FIG. 3).

A pair of rolls 34, 34' of plastic strip, having adhesive on one side, are mounted on the box by pivots 36, 36'. Each plastic strip is guided toward the opening 32 in the box 26, by a pair of rollers 38, 38' with its adhesive side in proximity to and adjacent the opening 32. As the filaments 24 flow through the opening 32, they are deposited on the adhesive surfaces of the strips 34, 34'. The rollers 38, 38' cause the strips to adhere to each other, capturing the filaments therebetween (FIG. 2).

Figure 5:
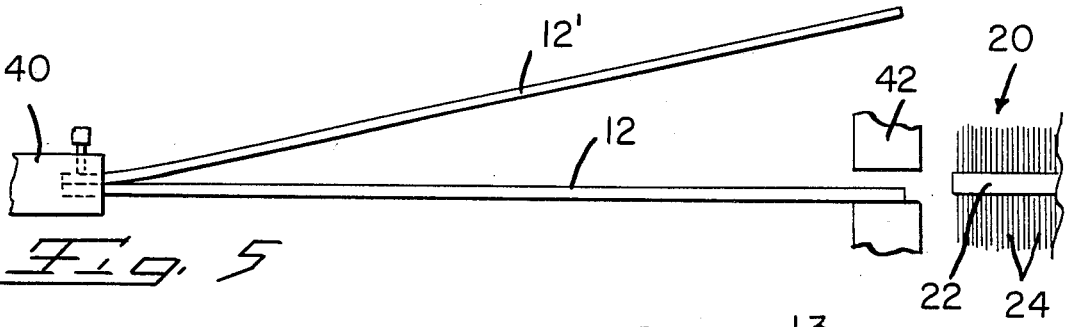
FIGS. 5–7 are diagramatic views illustrating a method of making a tree limb.
Figure 6:
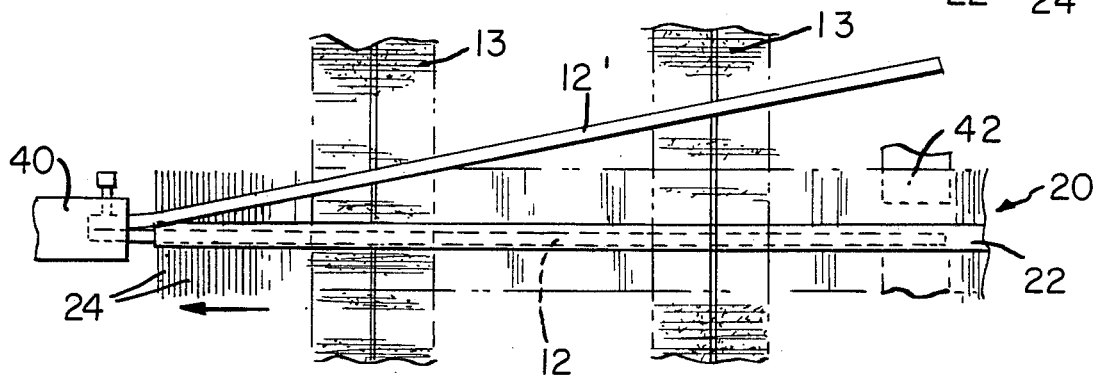
Figure 7:
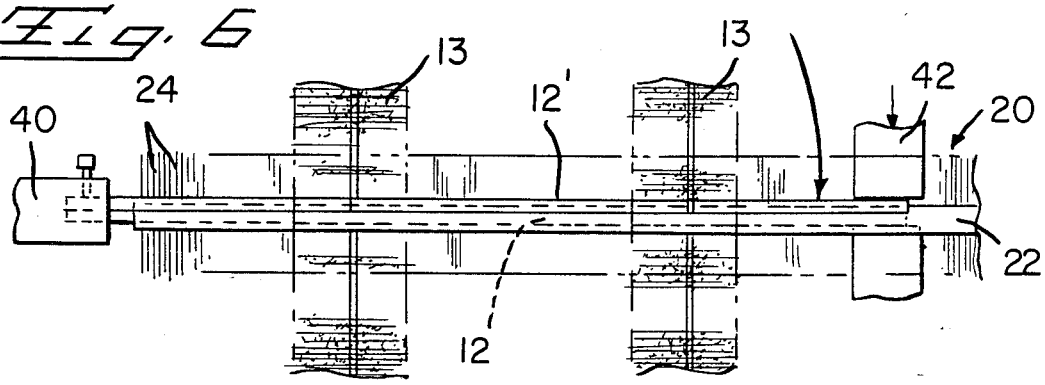

As shown in FIGS. 5–7, the limb is assembled by securing one end of the heavy gauge wires 12, 12' in a block member 40. The other ends of the heavy gauge wires are spread to permit introduction of the filler strip 20 therebetween (FIGS. 5 and 6).

Figure 9:
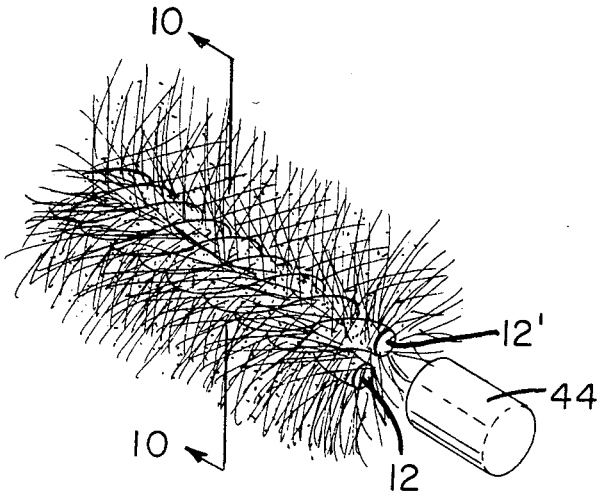
FIGS. 9, 10 and 11 illustrate a limb made by twisting a tape, as shown in FIG. 8 into heavy gauge wires.
Figure 10:
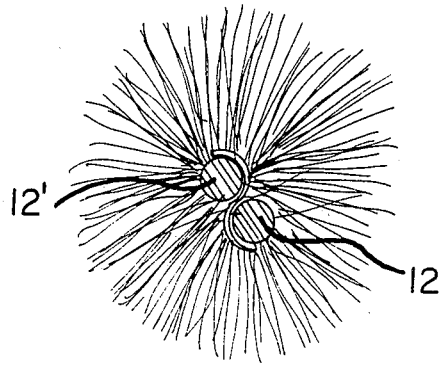
Figure 11:
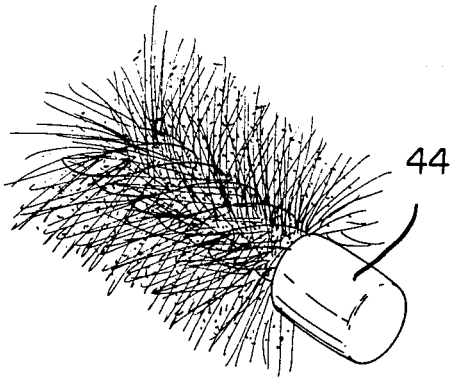

Branch members 13 are assembled by laying the branches between the heavy gauge wires 12, 12' (FIG. 6) and securing the heavy gauge wires in close parallel relationship by a second locking member 42 (FIG. 7). The locking member 42 is then rotated to twist the heavy gauge wire into a spiral (FIGS. 9 and 11).

As the heavy gauge wires form a spiral, the film 22 is captured between the wires and wire filaments 24, project from the limb 10 in rundown fashion, concealing the heavy gauge wires 12, 12'. A plastic cap 44 (FIGS. 9 and 11) of a desired color is pressed over the projecting end of the limb to protect against the sharp ends of the heavy gauge wires and give a more pleasing appearance.

Figure 8:
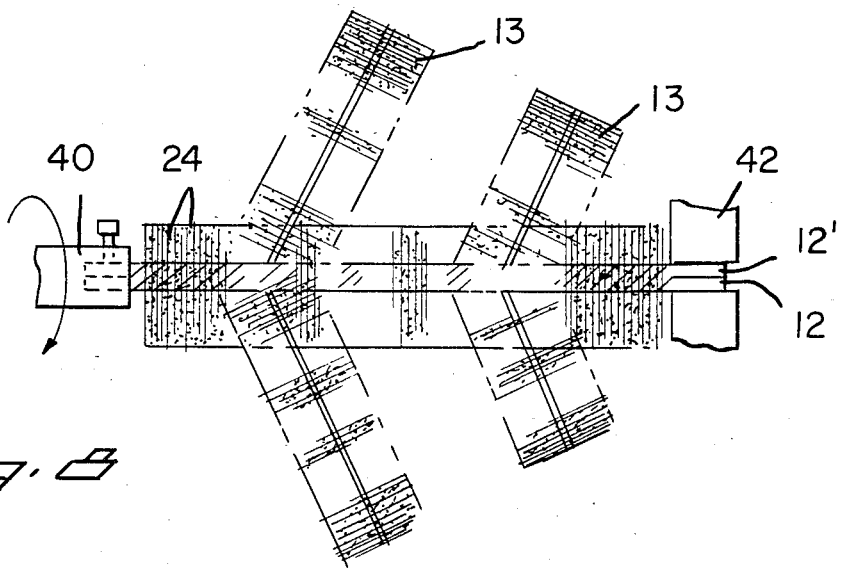
FIG. 8 illustrates a tape with filament twisted into heavy gauge wire to form a limb.

As the twisted heavy gauge wires 12, 12' wrap around each branch 13, the branches are captured therein and arranged in a forward direction (FIG. 8) thereby simulating the branches on the limb of a Christmas tree.

FIG. 13 illustrates an alternative embodiment. The filler strip 120 is comprised of a pair of light gauge, twisted wires with filament material captured therein, similar to the branch members 13 (FIG. 12). The filler members 120 are laid along the axis of the heavy gauge wires 116 and 118 (FIG. 13). A plurality of branch members 113 (similar to branch members 13) are positioned at right angles to the axis of the heavy gauge wires 116, 118.

The heavy gauge wires are again twisted to form a spiral (FIG. 13). The filler is trapped in the spiral configuration with the filaments protruding to conceal the wires 116, 118 and present a natural appearance. The branches 113 are grasped by the heavy gauge wires and held in place.

It is apparent that the artificial Christmas tree branches can be appended to a trunk member in various forms of assembly (e.g.: U.S. Pat. No. 4,305,980) to simulate an "evergreen" type tree. The filament material covering the limbs presents an attractive natural appearance, matching the filaments forming the artificial needles. The filament material would ordinarily be bright green but could be any color the consumer desired (e.g. white).

The carrier strip could employ clear material so as to be unnoticeable. Alternatively it could be a color matching the color of a tree limb. The color of the protective caps 44 is a matter of choice.

I claim:

1. In a member for an artificial tree comprising a limb with a plurality of branches attached to said limb, each of said branches being formed from a pair of wires and a plurality of thin brush stock filaments by placing said filaments across one of said wires transversely thereof, placing said second wire on the first and over said filaments, and then twisting said wires with said filaments interposed between said twisted wires along the length of said twisted wires, said limb having been made from a pair of wires of heavier gauge than said branch wires, the improvement comprising:

said limb being formed from said heavier-gauge wires, a plurality of said branches, and a plurality of thin brush stock filaments, by placing said filaments in close proximity to each other in a layer on a first one of said heavier-gauge wires with said filaments being disposed transversely of said first wire, placing a plurality of said branches on said first heavier-gauge wire in spaced relation to each other and transversely of said first wire, then placing said second heavier-gauge wire on said first heavier-gauge wire over said filaments and over said branches, then twisting said heavier-gauge wires together with said filaments and said branches captured between said heavier-gauge wires.

2. A member for an artificial tree according to claim 1 wherein said brush stock filaments that are disposed on said first heavier-gauge wire are adhesively attached crosswire to a flexible carrier strip, and said strip is interposed between said limb wires.

3. A member for an artificial tree according to claim 1 wherein said brush stock filaments are secured between a pair of twisted lighter-gauge wires, and said lighter-gauge wires are interposed between said limb wires.

* * * * *